US005975301A

United States Patent [19]

Stall et al.

[11] Patent Number: 5,975,301

[45] Date of Patent: Nov. 2, 1999

[54] VACUUM PACKED SHIRRED STICKS

[75] Inventors: Alan D. Stall, Naperville, Ill.; Jose-Luis R. Valdes, Madrid, Spain

[73] Assignee: Alfacel s.a., Madrid, Spain

[21] Appl. No.: 09/170,771

[22] Filed: Oct. 13, 1998

[51] Int. Cl.[6] ..... B65D 85/20

[52] U.S. Cl. ..... 206/446; 206/499; 206/802; 206/497; 53/444

[58] Field of Search ..... 206/443, 802, 206/497, 499; 229/87.05; 53/412, 444, 446, 447

[56] References Cited

U.S. PATENT DOCUMENTS

| | | | |
|---|---|---|---|
| 1,251,598 | 1/1918 | Vale . | |
| 2,028,691 | 1/1936 | Schenk . | |
| 2,181,329 | 11/1939 | Hewitt . | |
| 2,794,544 | 6/1957 | Firth . | |
| 2,814,382 | 11/1957 | Lassiter . | |
| 2,967,383 | 1/1961 | Rumsey, Jr. . | |
| 3,028,952 | 4/1962 | Milio et al. . | |
| 3,148,992 | 9/1964 | Hewitt . | |
| 3,164,934 | 1/1965 | Pancratz . | |
| 3,206,020 | 9/1965 | Billingsley et al. . | |
| 3,250,629 | 5/1966 | Turbak . | |
| 3,321,072 | 5/1967 | Alsys . | |
| 3,342,322 | 9/1967 | Weisner et al. . | |
| 3,419,401 | 12/1968 | Matecki . | |
| 3,471,305 | 10/1969 | Marbach . | |
| 3,528,825 | 9/1970 | Doughty . | |
| 3,564,647 | 2/1971 | Matecki . | |
| 3,570,045 | 3/1971 | Matecki . | |
| 3,627,116 | 12/1971 | Cooper . | |
| 3,764,351 | 10/1973 | Whittington et al. . | |
| 3,875,723 | 4/1975 | Sundin . | |
| 3,971,187 | 7/1976 | McNeill et al. | 206/802 X |
| 4,295,563 | 10/1981 | Becker et al. . | |
| 4,671,414 | 6/1987 | Bandt et al. . | |
| 4,730,437 | 3/1988 | Benno . | |
| 4,796,754 | 1/1989 | Chaussadas et al. . | |
| 4,818,551 | 4/1989 | Stall et al. . | |
| 4,844,129 | 7/1989 | Bridgeford et al. . | |
| 5,137,153 | 8/1992 | Hendriks . | |
| 5,228,572 | 7/1993 | Hendriks . | |
| 5,328,031 | 7/1994 | Hendriks . | |
| 5,356,007 | 10/1994 | Feldt . | |
| 5,381,643 | 1/1995 | Kazaitis et al. . | |
| 5,382,190 | 1/1995 | Graves | 53/444 X |
| 5,391,108 | 2/1995 | Feldt . | |
| 5,467,576 | 11/1995 | Handriks . | |
| 5,727,364 | 3/1998 | Artieda . | |
| 5,865,312 | 2/1999 | Stall | 206/802 X |

FOREIGN PATENT DOCUMENTS 0 672 593 A2 9/1995 European Pat. Off. .

*Primary Examiner*—Jacob K. Ackun
*Attorney, Agent, or Firm*—Marshall, O'Toole, Gerstein, Murray & Borun

[57] ABSTRACT

A caddy for packaging and transporting shirred food casings. A caddy according to the present invention comprises a plurality of shirred food casings, each of the shirred food casings being generally cylindrical and of generally equal length and diameter, with the food casings being arranged in a plurality of generally adjacent but offset rows to form a stack. The stack includes a bottom wall, a top wall, and a plurality of sidewalls. The stack is further defined by a pair of outside rows and a plurality of inside rows. At least one of the inside rows is laterally offset relative to its adjacent rows to thereby form a recessed notch adjacent one of the sidewalls. The same row also forms a protruding casing on the side opposite of the notch. A vacuum sealed peripheral retaining film surrounds the stack to thereby retain the food casings in the stack. The caddy of the present invention is adapted to be shipped with a plurality of similar caddies in such a manner that the caddies engage each other to thereby prevent relative movement during shipping.

28 Claims, 3 Drawing Sheets

VACUUM PACKED SHIRRED STICKS

FIELD OF THE INVENTION

The present invention relates to vacuum packaging of shirred cellulose casing used in the manufacture of food products such as sausage and/or hot dogs.

BACKGROUND OF THE INVENTION

Shirred cellulose casing used in the manufacture of sausage and/or hot dogs requires very specific packaging. The cellulose casing consists of regenerated cellulose, made in a tube, and described by numerous patents including U.S. Pat. Nos. 1,070,766; 1,158,400; 1,163,740; 1,601,686; 1,612,508; 1,645,050; 1,654,254; 2,999,756; 2,999,757; 3,835,113; 4,590,107; 4,778,639; and 5,358,765.

The tubular casing is typically moisturized and shirred on conventional shirring machines into a compressed tube, which compressed tube is commonly referred to as a shirred stick. Length reductions of 100 to 1 are common, that is, 100 feet of tubular casing is compressed and compacted into a shirred stick having a final length of one (1) foot, which greatly eases handling and dispensing on commercial sausage machines. A typical shirred stick has two hundred and twenty five (225) feet of casing, capable of producing over six hundred (600) hot dogs when filled with meat paste. Typical shirring patents include: U.S. Pat. Nos. 2,010,626; 2,498,948; 2,583,654; 2,722,714; 2,983,949; 3,222,192; 3,461,484; 3,452,982; 4,550,472; and 3,397,069. Moisturizing the casing during shirring is shown in many patents, such as U.S. Pat. Nos. 3,097,393; 3,110,058; 3,222,192; 3,451,827; 3,462,794; 3,898,348; 4,062,980; 4,062,981; 4,596,727; and 5,230,933.

Shirred sticks are somewhat fragile and it is critical that the shirred sticks are packaged adequately. Any loss of moisture, coherency or other critical variable can ruin the shirred stick. Thus, it is important that the packaging of the shirred sticks perform several functions. For example, the packaging should rigidly support the shirred sticks in order to prevent lateral abrasion, excess motion, and dimensional changes such as curving, bowing, and loss of stick coherency (in which the pleats un-nest and come apart), despite the presence of length or diameter variations. The packaging should be easy to open, provide for easy dispensing of the shirred sticks, and enhance moisture retention in the shirred sticks. It is also desirable that the packaging be easy to dispose of or recycle, and minimize the overall package volume in order to ease transportation and storage. Finally, the packaging should protect the shirred sticks against accidental wetting while the sticks are awaiting use in the stuffing room.

According to conventional practice, the shirred sticks are commonly bundled together in quantities of fifty (50) sticks. Each bundle of fifty sticks is called a caddy. Most meat packers prefer this conventional number of fifty sticks per caddy for ease of ordering and record keeping. Multiple caddies may be packed in a common carton or box, with typical cartons containing 4, 6 or 8 caddies, depending upon weight and convention. Each carton is opened outside the meat kitchen, and the caddies are individually carried into the kitchen.

In order to package shirred casing, several alternatives are possible. One approach has been to package the shirred casing in a rigid cardboard boxes, while another approach has been to use plastic packaging. Examples of rigid cardboard caddies can be found in many U.S. patents, such as U.S. Pat. Nos. 2,028,691; 2,181,329; 2,794,544; 3,028,952; 3,148,992; 3,250,629; 3,271,168; 3,321,072, 3,342,322; 3,471,305; 3,528,825; 3,616,989; and 3,627,116.

Although cardboard boxes are accepted in the industry as providing the best overall protection of shinned casings, due to hygienic reasons an increasing number of meat processors do not wish to have cardboard present in the sausage kitchen. Such processors thus require the use of all plastic caddies.

The general concept of plastic packaging can be found in many prior art U.S. patents. For example, U.S. Pat. No. 1,251,598 shows a concept to package tubular products in flexible pouches. U.S. Pat. No. 2,682,475 shows an early form of plastic packaging. U.S. Pat. No. 2,814,382 shows a product vacuum packed within a tightly-wrapped cellophane pouch in order to create an air tight container. U.S. Pat. No. 2,967,383 illustrates using thermally sensitive film that heat shrinks around a product and which also utilizes an internal vacuum to create a tightly wrapped article. U.S. Pat. No. 3,206,020 also illustrates a shrink wrapped film. Finally, U.S. Pat. No. 3,164,934 shows a device that employs a snorkels to vacuum seal a product in a heat sealed container.

The general concept of bundling a number of similar articles together is shown in U.S. Pat. Nos. 3,218,764, 3,875,723 and 3,283,893. Use of moisture barrier films and liners is shown in U.S. Pat. No. 3,233,815, while shrink wrapping of shirred sticks using plastic packaging with cardboard end supports is shown in U.S. Pat. No. 3,764,351.

U.S. Pat. No. 3,971,187 to McNeill shows vacuum packaged caddies of 50 shirred sticks. Configurations include 5×10 stacking, and 6-5-6 stacking. McNeill describes clearly the benefits of vacuum packaging, such as avoiding the tendency of going to a "round" shape created by shrink packaging methods. McNeill uses a film impervious to air passage having a vapor transmission rate less than 1 cc/100 in 2/24 hour/atm. McNeill also envelopes individual layers around separate rows. Evacuation is made to preferentially 0.6 to 0.75 atm, or between 3.7 and 5.9 in. Hg vacuum. McNeill describes vacuums exceeding 0.4 atm or exceeding 8.8 in. Hg as excessive and which will flatten the sticks.

U.S. Pat. No. 4,295,563 shows using impermeable pouches over wrapping shirred sticks where the interior of the pouch is gas flushed, while U.S. Pat. Nos. 4,671,414; 4,730,437; 4,796,754; and 5,467,576 show automatic packaging.

Conventional plastic packages for casings are shown in several patents. U.S. Pat. Nos. 5,137,153 and 5,228,572 uses a hexagonal package, with rows containing the following shirred sticks: 4-5-6-7-6-7-6-5-4, to reach 50. The package is not vacuumized. It also is unstable when laid on a flat table and can tip easily. Similarly, U.S. Pat. Nos. 5,356,007; 5,381,643 and 5,391,108 show using a stretch film to make a wrapping, with the stretch film being sealed with a low adhesive tape. This article is not vacuumized and it has been shown that in hot weather, the film can relax sightly, allowing excessive movement of the shirred sticks which bows and curves the sticks. Moreover, the caddies must be shipped in a double wall carton to protect them, which results in excessive use of cardboard.

U.S. Pat. No. 5,382,190 shows a caddy with layers of: 7-8-9-8-7-6-5 to add up to 50 sticks, while U.S. Pat. No. 5,727,364 and European Patent No. 0,672,593 A2 to Artieda show a packaging means with 5×10 stacking using an adhesive tape as a handle and wrapping the sticks in a non-shrink, non-stretch film. Although the Artieda package has a nice appearance, it has been found that any rough handling of the package immediately destroys the integrity of the 5×10 stack and the package slumps into a round or oval shape. Also, using the package is tricky in that if the package opens prematurely, sticks will slip onto the floor.

Each of the above-mentioned approaches suffers from one or more drawbacks, and accordingly there remains a need for an improved means of packaging.

SUMMARY OF THE INVENTION

The present invention preferably uses a vacuum sealed package. Vacuum sealing applies uniform force on the entire perimeter of the package and thus maintains the tightest integrity of the shirred sticks. It is economical, lends to heat sealing to avoid adhesive tapes, and is easy to open.

In accordance with at least one of the preferred embodiments, the preferred stacking is 6-7-8-8-8-7-6, which totals fifty (50) sticks per caddy. Preferably, the middle row is slightly offset compared to its two adjacent rows, creating a protruding stick on one side and a recess or notch on the opposite side. The protruding stick readily fits into the recess or notch of an adjacent package for tight and secure compaction in the carton.

According to one aspect of the invention, a caddy for packaging and transporting shirred food casings comprises a plurality of shirred food casings, each of the shirred food casings being generally cylindrical and of generally equal length and diameter, with the food casings being arranged in a plurality of generally adjacent but offset rows to form a stack. The stack includes a bottom wall, a top wall, and a plurality of sidewalls. The stack is further defined by a pair of outside rows and a plurality of inside rows. At least one of the inside rows is laterally offset relative to its adjacent rows to thereby form a recessed notch adjacent one of the sidewalls. The same row also forms a protruding casing on the side opposite of the notch. A vacuum sealed peripheral retaining film surrounds the stack to thereby retain the food casings in the stack.

In further accordance with a preferred embodiment, the notch is sized to receive a food casing, such as a protruding food casing from another similar caddy. Such an arrangement serves to mechanically lock the two similar caddies adjacent each other and to stabilize the stacks of food casings during transport and handling. The outside rows each include six casings and the inside rows include at least seven casings. Preferably, there are five inside rows, with three of the inside rows including eight casings, and with the middle row being offset relative to its adjacent rows.

With the casings so arranged, the stack will include five sidewalls, with the notch being formed in one of the sidewalls. At least two of the sidewalls intersect at a vertex, with the vertex being defined by the protruding casing.

According to another aspect of the invention, a caddy for packaging and transporting a plurality of shirred food casings comprises a plurality of shirred food casings, with each of the shirred food casings being generally cylindrical and of generally equal length and diameter. The food casings are generally arranged in a quincunxical stack having a plurality of rows, the stack being defined in part by a top row of casings defining a top wall, a bottom row of casings defining a bottom wall, and a plurality of inside rows defining in part a pair of interconnecting opposite sides. One of the sides forms a pair of sidewalls intersecting at a vertex, with the vertex being defined by a laterally protruding one of the casings. The other of the sides forms a pair of sidewalls converging at a recessed sidewall forming a notch. The recessed sidewall is defined by an inwardly offset one of the casings. A sealable peripheral raining film surrounds the stack to thereby retain the food casings in the stack. The retaining film is adapted to be drawn tightly around the stack upon application of a vacuum.

Vacuumized packages hold sticks straight, reduce curvature and bowing and reduce stick growth because only vacuumizing applies a substantially equal force around 100% of the periphery of a complete caddy.

The aforementioned features and advantages, in addition to other features and advantages, will become readily apparent to those skilled in the art upon a reading of the following detailed description.

DESCRIPTION OF THE PREFERRED EMBODIMENT

The embodiment described herein is not intended to be exhaustive or to limit the scope of the invention to the precise form disclosed. The following embodiment has been chosen and described in order to best explain the principles of the invention and to enable others skilled in the art to follow its teachings.

Figure 1:
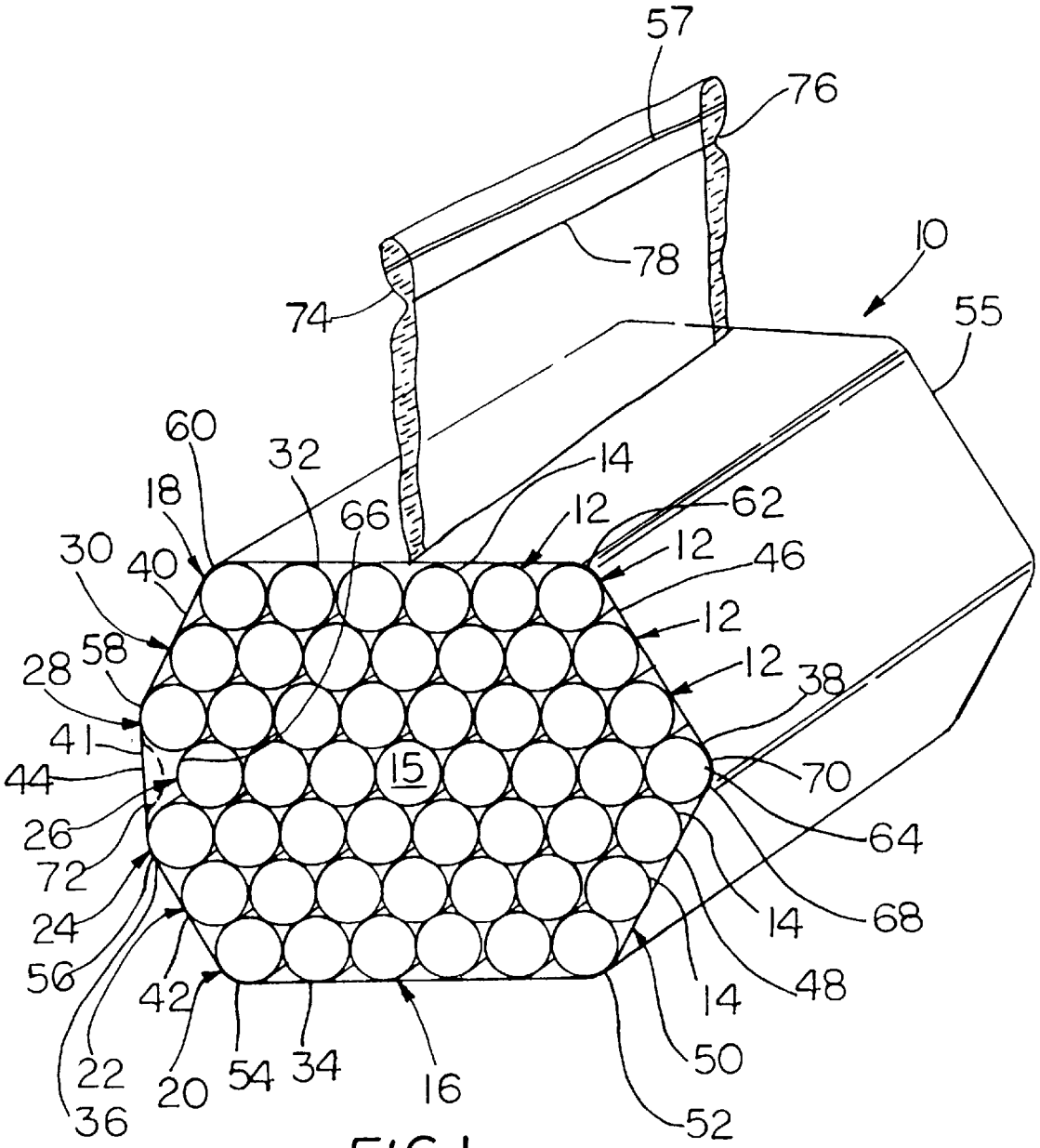
FIG. 1 is a perspective view of a caddy for shirred sticks constructed in accordance with the teachings of the present invention.

Referring now to the drawings, a caddy 10 is formed from a plurality of food casings 12. Typically, the food casings 12 will be shined as is well known in the art, and will have a 1 inch nominal diameter. Also, as is common practice, the food casings 12 are stacked in quantities of fifty (50) casings per caddy 10. As can be seen in the perspective view of FIG. 1, each of the casings 12 is generally cylindrical, and each casing 12 is of a generally equal length and diameter. Normal variations are contemplated. Each of the casings 12 forms a curved outer surface 14. The casings 12 are gathered or piled into a stack 16, such that the outer surface 14 of each casing 12 contacts or "nests" against the outer surface 14 of a plurality of adjacent casings 12. The stack 16 is thus formed from a plurality of rows, i.e. a top row 18, a bottom row 20, and a plurality of inside rows 22, 24, 26, 28 and 30. The plurality of casings 20 so arranged form a top wall 32, a bottom wall 34, and left and right sidewalls 36, 38. The left sidewall 36 includes a three faces or surfaces 40, 41 and 42. The surfaces 40, 42 are separated by the middle sidewall 41 which forms a notch 44 as will be explained below. The right sidewall 38 includes a pair of faces or surfaces 46, 48. A retaining film 50 surrounds the stack, and is preferably vacuumized as will be explained in greater detail below. By virtue of the shape of the caddy 10, the retaining film 50 thus forms a plurality of corners or vertexes 52, 54, 56, 58, 60, 62 and 64. The retaining film 50 also forms a pair of end walls 53, 55, and is gathered adjacent the top wall 32 and heat sealed along a seal line 57 in a conventional manner after evacuation of the air from inside of the caddy 10.

Row 26 is the middle row by virtue of its central location within the stack 16. As is evident from the FIGS. 1, 2 and 3, the middle row 26 is laterally offset relative to its adjacent rows, i.e., rows 24 and 28. The offset middle row 26 includes a pair of sides 66 and 68. The offset nature of the middle row 26 forms a protruding casing 70 adjacent the side 68, which effectively forms the vertex 64. The side 66 of the middle row 26 further forms the recess or notch 44 referred to above, and effectively forms the vertices 56 and 58. Upon application of the vacuum, the notch 44 in the middle sidewall 41 may form a curved surface 72, which is shown in dotted lines in each of the Figs.

Figure 3:
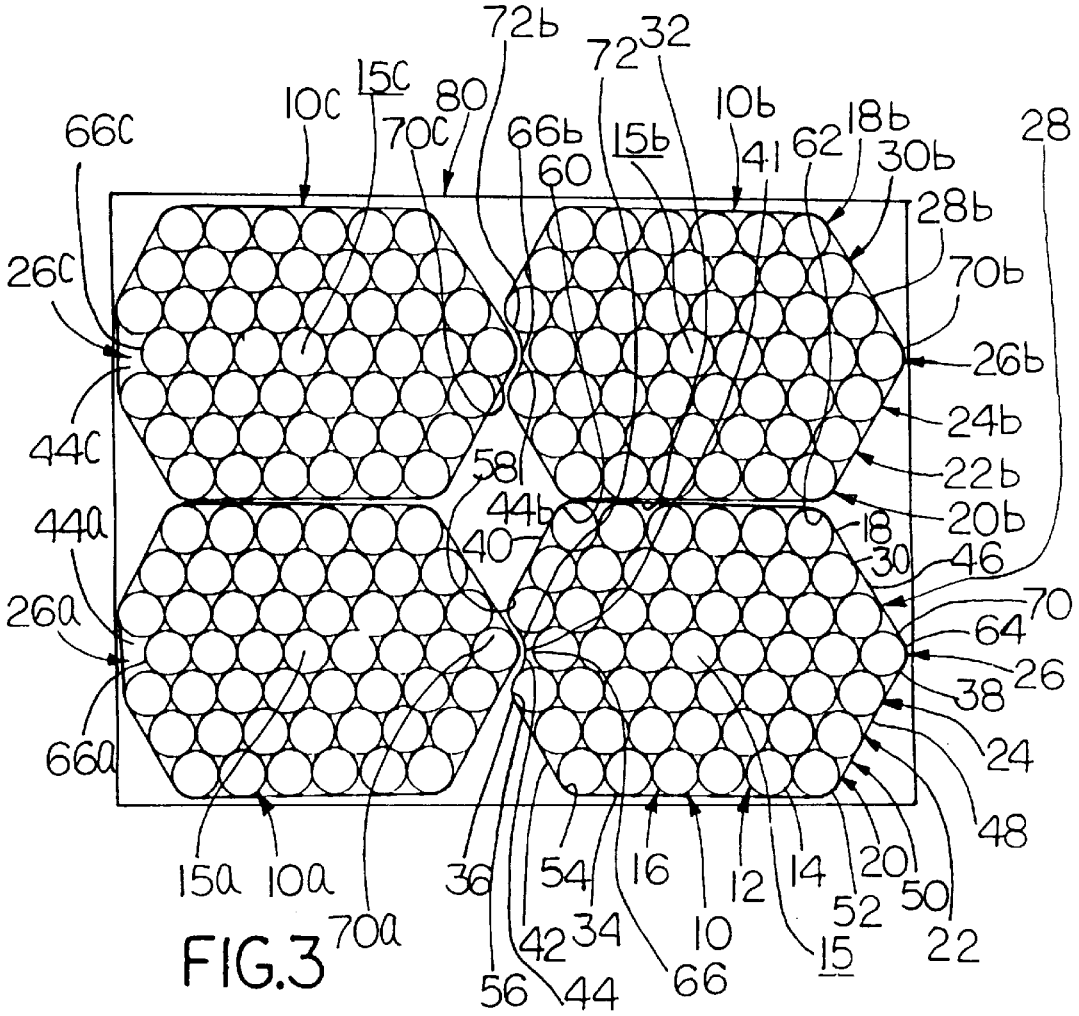
FIG. 3 is an elevational view of four (4) caddies assembled in accordance with the teachings of the present invention shown stacked together in a shipping box and illustrating the manner by which adjacent caddies interlock.

As is shown in FIG. 3, the curved surface 72 of the notch 44 is effectively sized to receive a protruding casing 70*a* from an adjacent caddy 10*a* as is shown in FIG. 3. Also as shown in FIG. 3, four identical caddies (i.e., caddies 10, 10*a*, 10*b* and 10*c*) may be collected and stacked together in a box or container 80. It will be understood that each of the caddies 10, 10*a*, 10*b*, 10*c* shown in FIG. 3 are identical, with the labeled component parts differing only by the addition of the appropriate suffix (i.e., a, b, or c).

The top and bottom rows 18 and 20 each include six (6) casings 12. The rows 22 and 30 each include seven (7) casings 12, while each of rows 24, 26 and 28 each include eight (8) casings 12. Accordingly, the arrangement of 6-7-8-8-8-7-6 totals up to fifty (50) casings 12 in the caddy 10.

The caddy has five angles at roughly 120 degrees (i.e., vertices 52, 54, 60, 62 and 64) and two at 150 degrees (i.e., vertices 56 and 58) and is thus a seven (7) angled package with seven (7) sides (i.e., sides 32, 34, 40, 41, 42, 46 and 48).

Figure 2:
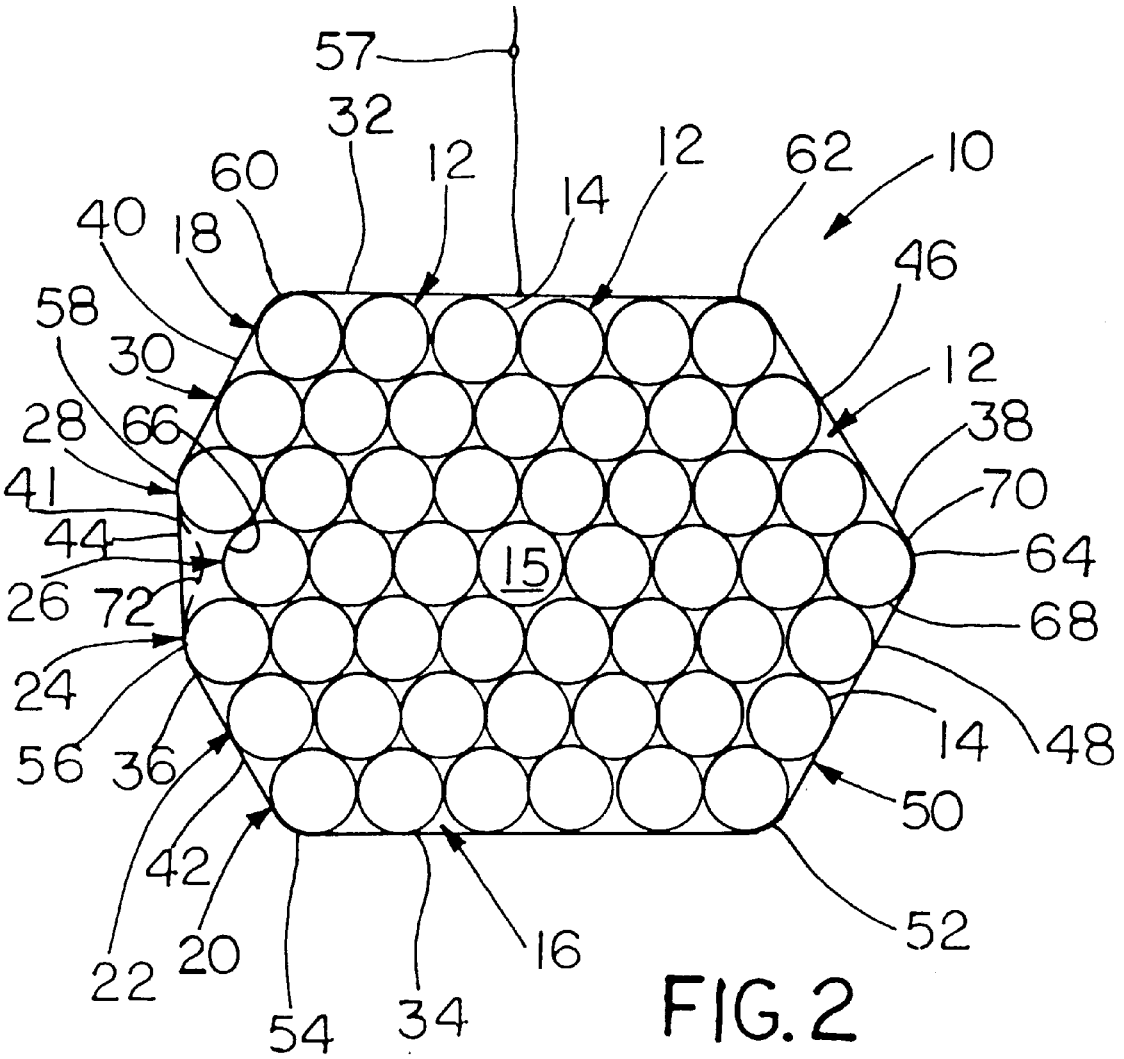
FIG. 2 is an elevational view of the caddy illustrated in FIG. 1.

The sealed caddy 10 is opened according to FIG. 2 by tearing the film 50 at either of two notches 74, 76. The seal 57 is preferably a ½ inch wide seal band. The film 50 is preferably monoaxially oriented and is placed in the heat sealer with the tear line (i.e., the line 78 interconnecting notches 74 and 76) following the longitudinal length of the casings 12. Consequently, a very easy pull on the package opens the bag.

FIG. 3 shows a typical arrangement of four (4) caddies 10 (i.e., caddies 10, 10*a*, 10*b*, 10*c*, and 10*d*) in a typical paperboard carton 80 with the protruding casing 70*a*, 70*c* on two of the caddies (10*a*, 10*c*, respectively) engaging and protruding slightly into the notches 44, 44*b*, respectively, in the other two caddies 10, 10*b*, respectively, thus improving the snugness of the fit and interlocking the four caddies against relative movement during shipping. In fact, whereas four (4) caddies of fifty (50) casings, each having an unshirred length of one hundred and twenty five feet (125 feet) normally fit into a carton of 14¾ inches×11¼ inches×16 inches (inside dimensions), the vacuum packed caddy 10 constructed in accordance with the teachings of the present invention will fit into a carton of 13½ inches×10¼ inches×16 inches, a reduction in volume of 17%.

Moreover, sticks packed in rectangular arrangements are highly subject to movement during vacuumizing because the film moves and can easily jar a stick which is in a metastable position (i.e., stacked one on top of another). By comparison, the caddy of the present invention offers significantly better stability.

EXAMPLE

Tests were conducted on USA Caliber 20 casing having an unshirred length of one hundred and twenty five (125) feet, compacted into 15 ½ inch sticks. Each stick had an outside diameter (OD) of 15/16 inches. By comparison, such a product is typically packaged in a caddy with a stacking of 6-5-6-5-6-5-6-5-6, such that the resulting caddy has dimensions of 5⅛ inches×6⅞ inches.

Fifty sticks were vacuumized in the above-described stack of 6-7-8-8-8-8-7-6 as per the invention using an Accu-Seal 635-4B6S Sealer from Accu-Seal Corp., San Diego, Calif. The sticks were placed in a Nylon-Adhesive-PE bag, 3 mils thick, 25×20 inches size, with 0.75 mil nylon and 2.25 mil PE, available as FreshPak 500 from Koch Supplies, Kansas City, Mo. The sticks were pulled to a 13 in. Hg vacuum, requiring 11 seconds of time to vacuumize. They were then heat sealed at 307° F., using a ⅜ inch ribbon impulse sealer, held for 2 seconds, then held clamped during cooling until the seal bar fell below 180° F.

The sticks were held one day and exhibited coherencies of 2.9 in-lbs, versus conventionally packaged sticks with coherencies of 1.75 in-lbs. Coherency was tested as per the methods used in U.S. Pat. No. 3,898,348.

By comparison, casings tested and packaged in square or rectangular arrangements have always shown the casings to block together upon opening the package due to metastable stacking (sticks stacked on crests, one on top of the other, as opposed to the nested or quincunxical arrangement employed by the present invention. Also, vacuum films typically exhibit very high energy at 90 degree corners, which also causes the casings to stick together. A test was made on conventional 5×10 stacking arrangement under the same sealing conditions, and showed sticks to block together upon opening the package.

In the stacking shown, if each stick is assumed to be 1 inch in diameter, the cross-sectional area of the package is 42.5 in.$^2$ The sticks represent 39.3 in.$^2$, so wasted space represents 3.2 in.$^2$, a ratio of 12.3 sticks to 1 part air. In contrast, a 5×10 stack is 50 in.$^2$ with wasted space of 10.7 in.$^2$ or 3.67 sticks to 1 part air. A 6-5-6-5-6-5-6-5-6 stacking has a total cross-sectional area of 44.62 or a wasted space of 5.32 in.$^2$ and a ratio of 7.39 stick to 1 part air. The perimeter of the invention is 24.96 inches whereas a 5×10 stacking has a perimeter of 30 inches.

By comparison, other patents, such as U.S. Pat. No. 5,382,190, list the cross-sectional area at 44.69 units with a perimeter of 24.14 units. There are twenty two (22) casings on the outside surface. The invention similarly has twenty two (22) casings around its perimeter, but one casing is recessed, so actually only twenty one (21) casings touch the retaining film 50. The present invention also has six (6) sticks on the bottom side, while the stack disclosed in U.S. Pat. No. 5,382,190 has only five (5) sticks on the bottom side.

Vacuum sealing offers unparalleled support for the sticks, ease of use, hermetic sealing, minimum environmental waste and customer acceptance. It is especially advantageous when using non-rectangular packages, such as the generally hexagonally shaped caddies shown in the Figs.

It will be understood that the above description does not limit the invention to the above-given details. It is contemplated that various modifications and substitutions can be made without departing from the spirit and scope of the following claims.

What is claimed:

1. A caddy for packaging and transporting shirred food casings, comprising:

a plurality of shirred food casings, each of the shirred food casings being generally cylindrical and of generally equal length and diameter, the food casings being arranged in a plurality of generally adjacent but offset rows to form a stack, the stack having a bottom wall, a top wall, and a plurality of sidewalls;

the stack further being defined by a pair of outside rows and a plurality of inside rows, at least one of the inside rows being laterally offset relative to its adjacent rows, the one offset row thereby forming a recessed notch adjacent one of the sidewalls and further forming a protruding casing opposite the notch and adjacent another of the sidewalls; and a vacuum sealed peripheral retaining film surrounding the stack to thereby retain the food casings in the stack.

2. The caddy of claim 1, wherein the notch is sized to receive a food casing.

3. The caddy of claim 1, including a second stack of shirred food casings surrounded by a vacuum sealed peripheral retaining film and being identical to the first mentioned stack, and further wherein the first stack protruding casing is sized to be received in the second stack notch, thereby interlocking the first stack and the second stack and thereby preventing relative movement.

4. The caddy of claim 1, wherein the outside rows each include six casings, and wherein the inside rows include at least seven casings.

5. The caddy of claim 4, including five inside rows, wherein three of the inside rows include eight casings, and further wherein a middle row is offset relative to its adjacent rows.

6. The caddy of claim 4, including five inside rows, two of the inside rows being disposed next to an adjacent outside row and including seven casings, three of the inside rows being disposed near the center of the stack and including eight casings, and wherein one of the eight casing rows is offset.

7. The caddy of claim 1, wherein the stack includes five sidewalls.

8. The caddy of claim 7, wherein the notch is formed in one of the sidewalls.

9. The caddy of claim 1, wherein at least two of the sidewalls intersect at a vertex, the vertex being defined by the protruding casing.

10. A caddy for packaging and transporting a plurality of shirred food casings, comprising:

a plurality of shirred food casings, each of the shirred food casings being generally cylindrical and of generally equal length and diameter, the food casings being arranged side by side in a plurality of generally adjacent but offset rows to form a stack, the stack being defined in part by a top row of casings defining a top wall, a bottom row of casings defining a bottom wall, and a plurality of inside rows of casings defining a pair of interconnecting opposite sides;

one of the sides forming a pair of sidewalls intersecting at a vertex, the vertex being defined by a laterally protruding one of the casings;

the other of the sides forming a pair of sidewalls converging at a recess, the recess being defined by an inwardly offset one of the casings; and a vacuum sealed peripheral retaining film surrounding the stack to thereby retain the food casings in the stack.

11. The caddy of claim 10, wherein the laterally protruding casing and the inwardly offset casing are in a middle one of the rows.

12. The caddy of claim 10, wherein the laterally protruding casing and the inwardly offset casing are in the same row.

13. The caddy of claim 10, including a second stack of shirred food casings surrounded by a vacuum sealed peripheral retaining film and being identical to the first mentioned stack, and further wherein the first stack protruding casing is sized to be received in the second stack recess, thereby interlocking the first stack and the second stack and thereby preventing relative movement.

14. The caddy of claim 10, wherein the top and bottom rows each include six casings, and wherein each of the inside rows include at least seven casings.

15. The caddy of claim 14, including five inside rows, wherein three of the inside rows include eight casings, and wherein a middle row is laterally offset relative to its adjacent rows.

16. The caddy of claim 14, including five inside rows, one of the inside rows being disposed adjacent the top row and one of the inside rows being disposed adjacent the bottom row, three of the inside rows being disposed near the center of the stack and including eight casings.

17. The caddy of claim 16, wherein a middle one of the eight casing rows is laterally offset.

18. The caddy of claim 17, including fifty casings, and wherein twenty one of the casings contact the retaining film.

19. A caddy for packaging and transporting a plurality of shirred food casings, comprising:

a plurality of shirred food casings, each of the shirred food casings being generally cylindrical and of generally equal length and diameter, the food casings being generally arranged in a quincunxical stack having a plurality of rows, the stack being defined in part by a top row of casings defining a top wall, a bottom row of casings defining a bottom wall, and a plurality of inside rows defining in part a pair of interconnecting opposite sides;

one of the sides forming a pair of sidewalls intersecting at a vertex, the vertex being defined by a laterally protruding one of the casings;

the other of the sides forming a pair of sidewalls converging at a recess, the recess being defined by an inwardly offset one of the casings; and a sealable peripheral retaining film surrounding the stack to thereby retain the food casings in the stack, the retaining film being adapted to be drawn tightly around the stack upon application of a vacuum.

20. The caddy of claim 19, wherein the retraining film defines an outer wall, and wherein twenty one casings contact the outer wall.

21. The caddy of claim 20, in combination with a box, and wherein four such caddies are stacked in the box, the box having a cross-sectional area of approximately 138⅜ $in^2$.

22. A method of packaging shirred food casings for storage and transport, the method comprising the steps of:

collecting a plurality of shirred food casings into a stack having a plurality of rows;

offsetting laterally one of the rows relative to its adjacent rows, thereby forming a notch at one end of the offset row and a protruding casing at the other end of the laterally offset row;

surrounding the stack with a retaining film to form a pouch; and vacuum sealing the pouch.

23. The method of claim 22, wherein the stack includes fifty food casings.

24. The method of claim 22, including the additional steps of creating a top row and a bottom row having six food casings, and creating a plurality of inside rows having at least seven food casings.

25. The method of claim 24, including the additional step of creating a plurality of inner rows having eight food casings.

26. The method of claim 22, wherein the stack includes seven rows and further wherein the middle row is the offset row.

27. The method of claim 22, wherein the step of vacuum sealing the pouch includes the step of vacuumizing the pouch to about 13 in. Hg vacuum.

28. The method of claim 22, including the additional step of placing the caddy in a container adjacent to a second similar caddy, and positioning the second caddy so that a protruding casing from the second caddy engages the notch in the first mentioned caddy.

* * * * *